US010612829B2

(12) United States Patent
Carballo et al.

(10) Patent No.: US 10,612,829 B2
(45) Date of Patent: Apr. 7, 2020

(54) DYNAMIC HUMIDITY CONTROL SYSTEM

(71) Applicant: Haier US Appliance Solutions, Inc., Wilmington, DE (US)

(72) Inventors: Daniel Carballo, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 162 days.

(21) Appl. No.: 15/486,408

(22) Filed: Apr. 13, 2017

(65) Prior Publication Data

US 2018/0299144 A1 Oct. 18, 2018

(51) Int. Cl.
*F25D 11/00* (2006.01)
*F25D 17/04* (2006.01)

(52) U.S. Cl.
CPC ..... *F25D 11/00* (2013.01)

(58) Field of Classification Search
CPC ..... F25D 17/04; F25D 17/06; F25D 17/065; F25D 2317/061; F25D 2600/04; F24F 2110/20; G05D 22/00; G05D 22/02
USPC ..... 62/187
See application file for complete search history.

(56) References Cited

U.S. PATENT DOCUMENTS 2,133,958 A * 10/1938 Kalischer ..... F25D 17/042 236/44 R
3,600,905 A 8/1971 Dymek et al.
4,850,206 A * 7/1989 Larsen ..... F25D 17/04 62/382
5,368,786 A 11/1994 Dinauer
5,538,471 A 7/1996 Guiles, Jr.
5,578,753 A 11/1996 Weiss et al.
6,481,222 B1 11/2002 Denniston
6,826,920 B2 12/2004 Wacker
2006/0130498 A1* 6/2006 Joshi ..... A23L 3/3445 62/127
2010/0050666 A1* 3/2010 Meyer ..... B01D 53/261 62/94

FOREIGN PATENT DOCUMENTS

EP 1959215 A2 8/2008

* cited by examiner

*Primary Examiner* — Marc E Norman
(74) *Attorney, Agent, or Firm* — Dority & Manning, P.A.

(57) ABSTRACT

A humidity control system for regulating the relative humidity of a chamber enclosed within a low humidity environment is provided. An exemplary humidity control system includes features that can provide for dynamic control of the relative humidity of the chamber, utilize relatively minimal energy, readily maintain the desired relative humidity within the chamber, and/or some combination thereof.

17 Claims, 8 Drawing Sheets

DYNAMIC HUMIDITY CONTROL SYSTEM

FIELD OF THE INVENTION

The present subject matter relates generally to humidity control systems.

BACKGROUND OF THE INVENTION

Many processes, objects, and environments can benefit from specific humidity states. For example, one or more food items stored within a refrigerator appliance can benefit from specific humidity states to better preserve the food items. As another example, artifacts or works of art can benefit from specific humidity states to preserve the integrity of the artifact or work of art. Despite the benefits of specific humidity states, the ability to control humidity accurately is difficult due to the non-linear relationship between relative humidity, temperature, and moisture content. For instance, small changes in temperature can lead to large changes in relative humidity.

Conventional humidity control systems have controlled the humidity of chambers or enclosed spaces by cooling the air and then reheating the air to the appropriate temperature. This method can be relatively energy intensive and it can be difficult to maintain a desired relative humidity within the chamber with such conventional systems. Moreover, conventional humidity control systems typically add or remove humidity at a constant rate.

Accordingly, a humidity control system capable of dynamic humidity control of a chamber with minimal additional energy use would be useful.

BRIEF DESCRIPTION OF THE INVENTION

The present subject matter provides a humidity control system for regulating the relative humidity of a chamber enclosed within a low humidity environment. An exemplary humidity control system includes features that can provide for dynamic control of the relative humidity of a chamber, utilize relatively minimal energy, readily maintain the desired relative humidity within the chamber, and/or some combination thereof. Additional aspects and advantages of the invention will be set forth in part in the following description, or may be apparent from the description, or may be learned through practice of the invention.

In one exemplary aspect, a humidity control system for regulating the relative humidity of a chamber enclosed within a low humidity environment is provided. The humidity control system includes a damper adjustable between one or more open positions and a closed position for selectively allowing an airflow exchange between the chamber and the low humidity environment. The humidity control system also includes a motor for selectively actuating the damper between the one or more open positions and the closed position. The humidity control system further includes a humidity sensor positioned within the chamber. In addition, the humidity control system includes a controller communicatively coupled with the humidity sensor and the motor, the controller configured to: receive a humidity value from the humidity sensor; and activate the motor to actuate the damper to one of the open positions or the closed position based at least in part on the humidity value.

In some various embodiments, after receiving the humidity value from the humidity sensor, the controller is further configured to: compare the humidity value to a humidity set point.

In some various embodiments, the humidity set point is selected by a user.

In some various embodiments, the humidity set point is selected by the controller based at least in part on one or more items placed within the chamber.

In some various embodiments, the low humidity environment is a refrigerator appliance and the chamber is a refrigerator compartment of the refrigerator appliance.

In some various embodiments, the humidity control system further includes an air circulation device for circulating the airflow into or out of the chamber, the air circulation device communicatively coupled with the controller. In addition, the controller is further configured to: activate the air circulation device to modulate the airflow based at least in part on the humidity value received from the humidity sensor.

In some various embodiments, the humidity control system further includes a humidifier positioned within the chamber, the humidifier communicatively coupled with the controller. In addition, the controller is further configured to: activate the humidifier to provide moisture to the chamber.

In some various embodiments, the humidity control system further includes a humidifier positioned within the chamber and communicatively coupled with the controller. Moreover, the controller is further configured to: compare the humidity value to a humidity set point; and increase the relative humidity of the chamber via the humidifier based at least in part on a difference between the humidity value and the humidity set point.

In some various embodiments, the chamber has a relative humidity between about seventy-five (75%) and about one hundred percent (100%).

In some various embodiments, the low humidity enclosed space has a relative humidity between about twenty percent (20%) and about fifty percent (50%).

In another exemplary aspect, a method for regulating the relative humidity of a chamber enclosed within a low humidity environment is provided. The method includes receiving a relative humidity of the chamber; comparing the humidity value to a humidity set point; and modulating a damper to selectively allow an airflow exchange between the chamber and the low humidity environment based at least in part on a difference between the humidity value and the humidity set point.

In some various implementations, the method further includes modulating an air circulation device to increase a rate of the airflow exchange between the chamber and the low humidity environment based at least in part on the difference between the humidity value and the humidity set point.

In some various implementations, a humidifier is positioned within the chamber and the method further includes increasing the relative humidity of the chamber via the humidifier based at least in part on the difference between the humidity value and the humidity set point.

In some various implementations, a humidity sensor is positioned within the chamber and the method further includes sensing the humidity value of the chamber with the humidity sensor.

In some various implementations, the humidity set point is a sinusoidal function.

In some various implementations, the sinusoidal function varies in phase over time by about twenty percent (20%) relative humidity.

In some various implementations, the humidity set point is a constant function.

In some various implementations, the method further includes determining the type of one or more items within the chamber; and adjusting the humidity set point based at least in part on the one or more items within the chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
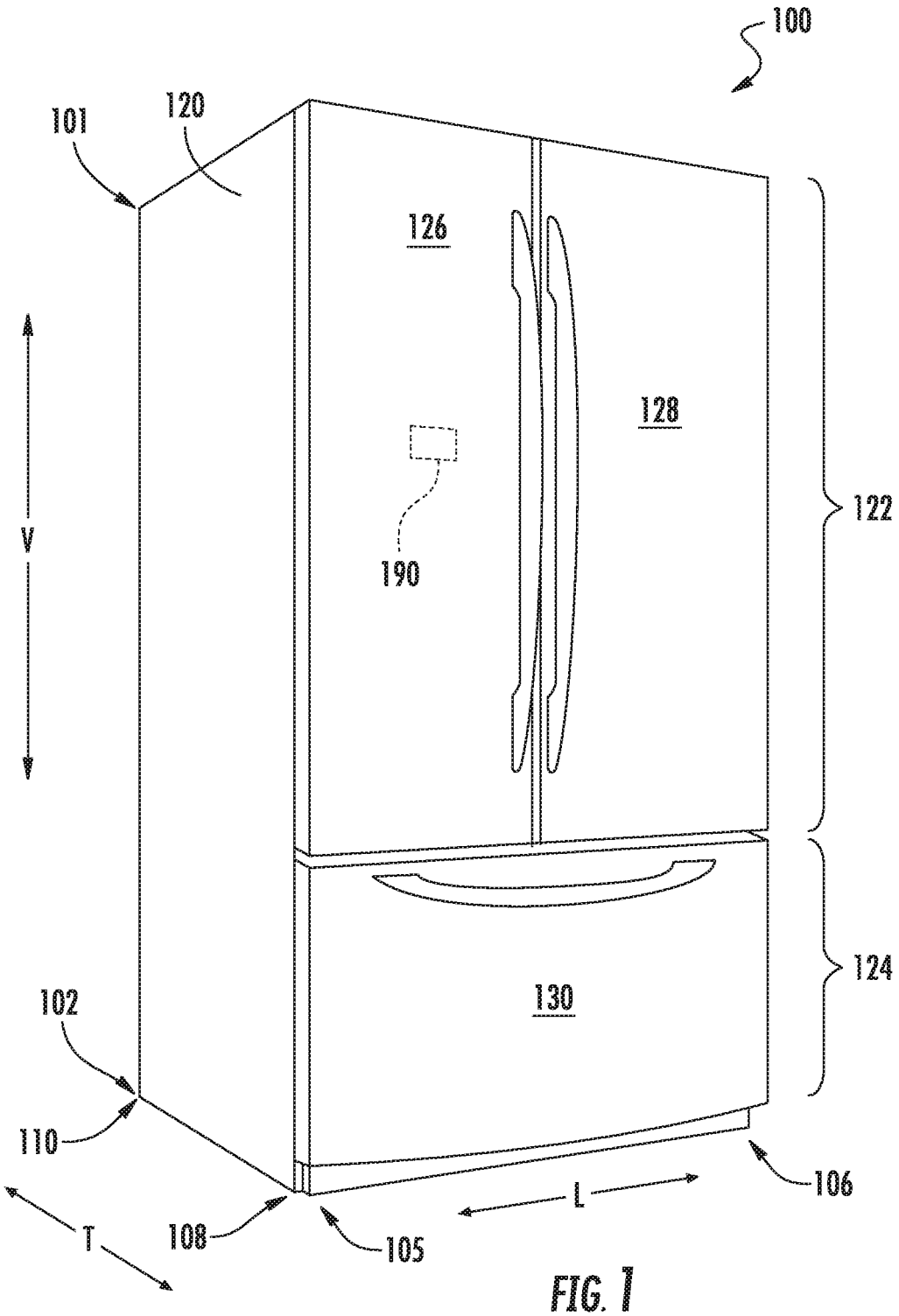
FIG. 1 provides a front, elevation view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, "relative humidity" is the ratio of the actual amount of moisture in the air at a particular temperature to the given maximum amount of moisture the air can hold at that temperature. Relative humidity can range from zero (0) for dry air to one hundred (100) percent for saturated air, or air that cannot hold any additional moisture. "Humidity" is the quantity of water vapor or moisture within the air of a particular environment.

FIG. 1 provides a perspective view of a refrigerator appliance 100 according to exemplary embodiments of the present subject matter. Refrigerator appliance 100 includes a housing or cabinet 120 that extends between an upper portion 101 and a bottom portion 102 along a vertical direction V. Cabinet 120 also extends between a first side 105 and a second side 106 along a lateral direction L and between a front 108 and a rear 110 along a transverse direction T. Vertical direction V, lateral direction L, and transverse direction T are mutually perpendicular and form an orthogonal direction system.

Cabinet 120 defines chilled chambers for receipt of food items for storage. In particular, refrigerator appliance 100 defines a fresh food chamber 122 at upper portion 101 of refrigerator appliance 100 and a freezer chamber 124 arranged below fresh food chamber 122 on the vertical direction V, e.g., at bottom portion 102 of refrigerator appliance 100. As such, refrigerator appliance 100 is generally referred to as a bottom mount refrigerator appliance. However, using the teachings disclosed herein, one of skill in the art will appreciate that the teachings of the present disclosure may be used with other types of refrigerator appliances (e.g., side-by-side style or top mount style) or a freezer appliance. Moreover, it will be appreciated that the teachings of the present disclosure may be used with any suitable low humidity environment in which a chamber can be enclosed such that the low humidity environment can selectively exchange a volume of air with the chamber and vice versa. The teachings of the present disclosure can be applied to a wide variety of applications including laboratories, medical facilities, storage facilities, and museums, among other possible applications. Consequently, the description set forth herein is for illustrative purposes only and is not intended to limit the present subject matter in any aspect.

Refrigerator doors 126 and 128 are rotatably hinged to an edge of cabinet 120 for accessing fresh food compartment 122. In particular, refrigerator doors 126 and 128 are rotatably mounted to cabinet 120 to permit access to fresh food chamber 122. A freezer door 130 is arranged below refrigerator doors 126 and 128 for accessing freezer chamber 124. Freezer door 130 is coupled to a freezer drawer (not shown) slideably mounted within freezer chamber 124.

Operation of the refrigerator appliance 100 can be regulated or controlled by a processing unit or controller 190 that is communicatively coupled with various components of refrigerator appliance 100. For example, controller 190 can be communicatively coupled with one or more user interfaces (not shown) of refrigerator appliance 100 for user manipulation of the operation of refrigerator appliance 100 such as e.g., selection of relative humidity levels of one or more bins, compartments, or sections of refrigerator appliance, among other options. In response to user manipulation of one of the user interfaces, controller 190 operates various components of refrigerator appliance 100. Controller 190 can be any suitable type of controller capable of regulating and controlling operations of refrigerator appliance 100 and its various sub-assemblies. For this embodiment, controller 190 is a proportional-integral-derivative controller (PID controller) configured to control various aspects and functions of refrigerator appliance 100 and its sub-assemblies.

Controller 190 can include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment of FIG. 1, controller 190 is located within refrigerator door 126. In such an embodiment, input/output ("I/O") signals may be routed between controller 190 and various operational components of refrigerator appliance 100. The user interface may be communicatively coupled with controller 190 via one or more wired or wireless signal lines or shared communication busses.

Figure 2:
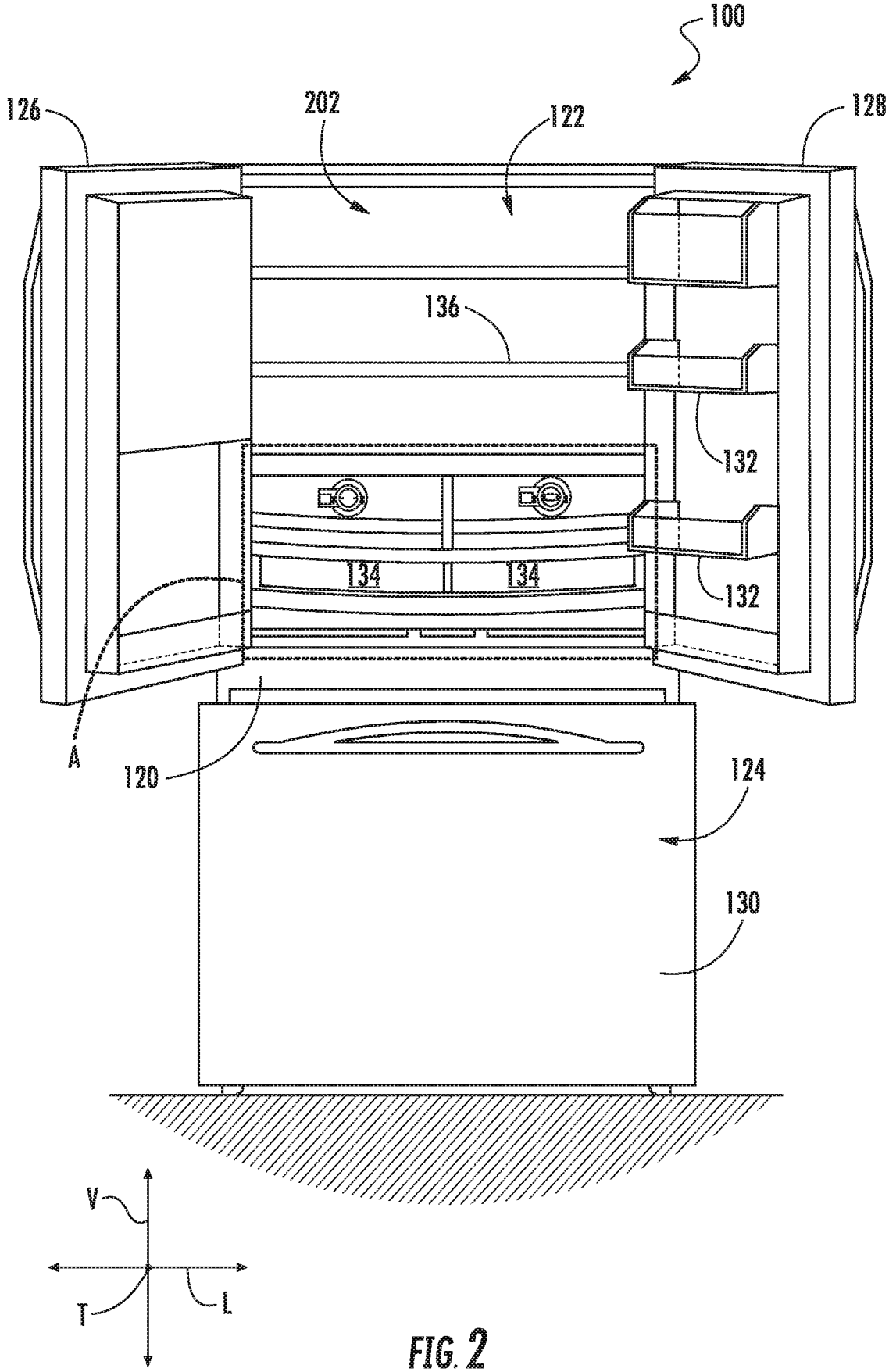
FIG. 2 provides a front, elevation view of the exemplary refrigerator appliance of FIG. 1 with refrigerator doors of the refrigerator appliance shown in an open configuration.

FIG. 2 provides a front, elevation view of refrigerator appliance 100 with refrigerator doors 126 and 128 of refrigerator appliance 100 shown in an open position to reveal fresh food chamber 122 of refrigerator appliance 100. As shown, various storage components are mounted within fresh food chamber 122 to facilitate storage of food items therein. In particular, the storage components include bins 132, drawers 134, and shelves 136 that are mounted within fresh food chamber 122. Although not shown, freezer chamber 124 can likewise include such storage components. Bins 132, drawers 134, and shelves 136 are configured for receipt of food items (e.g., beverages and/or solid food items) and may assist with organizing such food items. As an example, drawers 134 can receive fresh food items (e.g., vegetables, fruits, and/or cheeses) and increase the useful life of such fresh food items.

Moreover, it will be appreciated that the air within fresh food chamber 122 undergoes various cooling cycles (such as e.g., vapor-compression cooling cycles) in order to maintain a particular range of cooled temperatures within fresh food chamber 122. Generally, to facilitate cooling of the air within fresh food chamber 122, moisture is removed from the air, and as a result, fresh food chamber 122 may define a low humidity environment 202.

Figure 3:
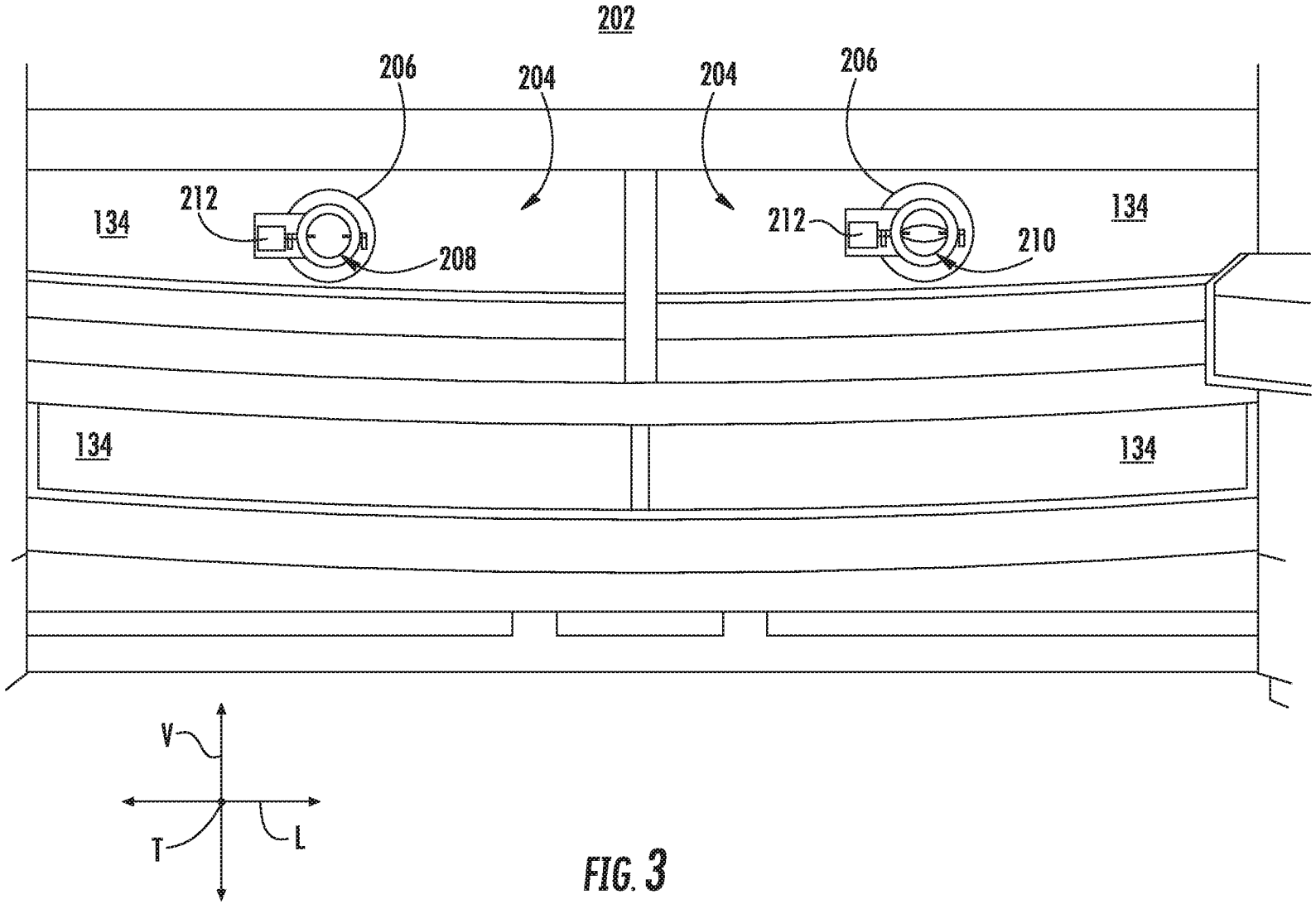
FIG. 3 is a front, close-up view of Section A of FIG. 2 depicting multiple chambers of the exemplary refrigerator appliance.

FIG. 3 is a front, close-up view of Section A of FIG. 2 depicting multiple drawers 134 of refrigerator appliance 100. For this embodiment, the top two drawers 134 each define a chamber 204 and each chamber 204 includes at least one damper 206 for selectively allowing an airflow exchange between the air within chamber 204 and the air of low humidity environment 202 of fresh food chamber 122. For instance, the chamber 204 positioned on the right in FIG. 3 includes damper 206 positioned in an open position 210 such that there is airflow exchange between the chamber 204 and low humidity environment 202. However, damper 206 need not be in the open position 210. As shown, chamber 204 positioned on the left in FIG. 3 includes damper 206 positioned in a closed position 208 such that there is no airflow exchange between chamber 204 and low humidity environment 202. For this embodiment, damper 206 includes a butterfly valve to selectively allow airflow exchange between chamber 204 and low humidity environment 202. Each damper 206 includes a motor 212 that actuates the butterfly valve of damper 206 for allowing airflow exchange. Other suitable valves and controls may be used as well.

Chamber 204 can be any geometric enclosure that imposes a significant barrier to mass transfer into or out of chamber 204. As one example, chamber 204 can be a sealed, airtight chamber. As another example, chamber 204 can be an enclosure that is about ninety percent (90%) sealed by surface area. As another example, chamber 204 can be an enclosure that is about eighty percent (80%) sealed by surface area. As another example, chamber 204 can be an enclosure that is about seventy-five percent (75%) sealed by surface area. As another example, chamber 204 can be a crisper drawer of a refrigerator appliance. As another example, chamber 204 can be a high-humidity drawer of a refrigerator appliance. As another example, chamber 204 can be an enclosed case for storing artwork. It will be appreciated that chamber 204 can be other suitable enclosures that impose a significant barrier to mass transfer into or out of chamber 204.

Figure 4:
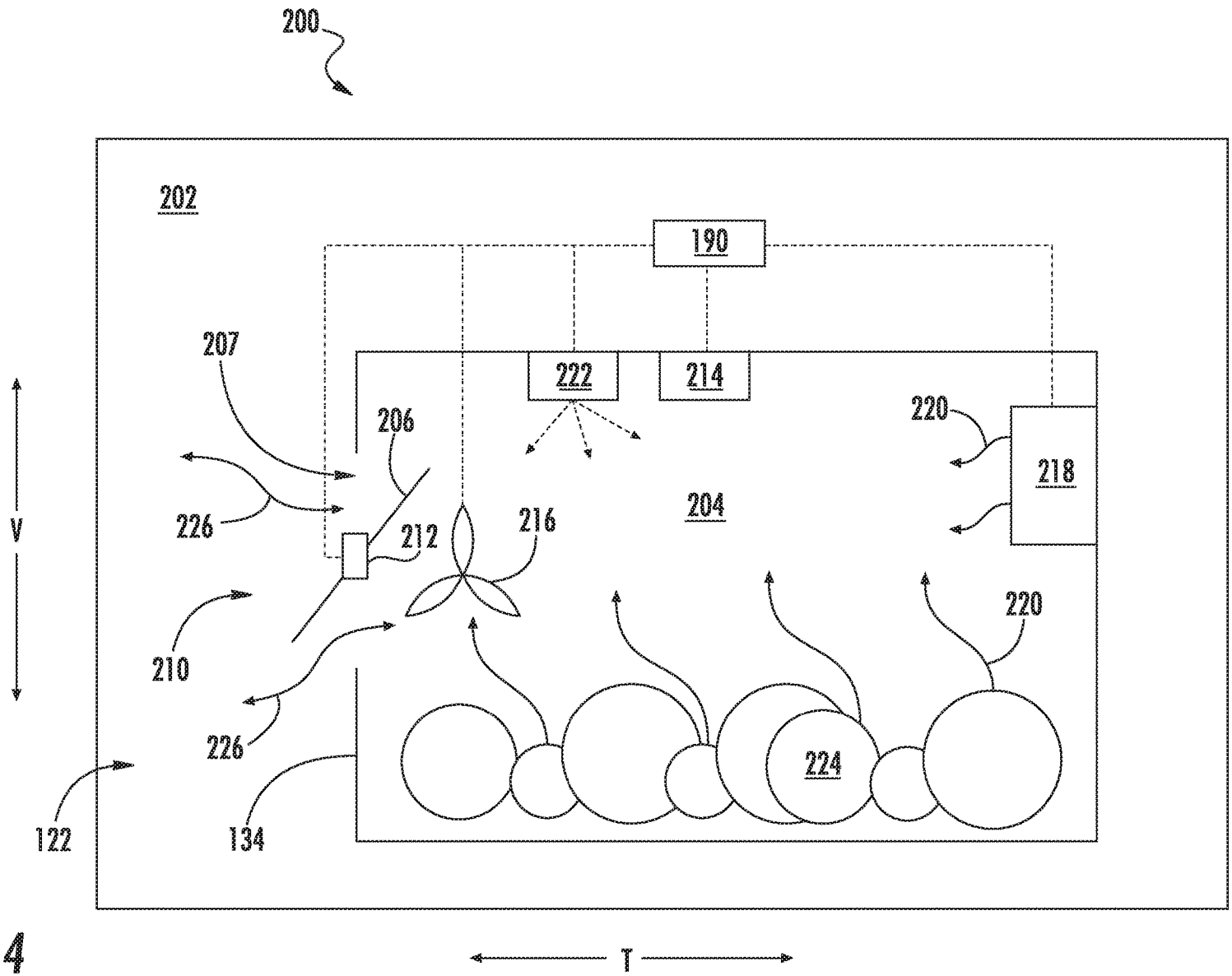
FIG. 4 is a schematic view of an exemplary dynamic humidity control system according to exemplary embodiments of the present disclosure.

FIG. 4 provides a schematic view of an exemplary dynamic humidity control system 200 according to exemplary embodiments of the present disclosure. Humidity control system 200 regulates the humidity and/or relative humidity of chamber 204 enclosed within low humidity environment 202. For this embodiment, chamber 204 is a refrigerator storage compartment of refrigerator appliance 100, such as e.g., drawer 134, and low humidity environment 202 is fresh food chamber 122 of refrigerator appliance 100. Food items 224 are shown being stored within chamber 204. Food items 224 may benefit from specific humidity states regulated by humidity control system 200 such that they may be better preserved.

Humidity control system 200 includes damper 206. Damper 206 is shown positioned or affixed to a sidewall of drawer 134 that defines chamber 204. Damper 206 is adjustable between one or more open positions 210 and the closed position 208 for selectively allowing airflow exchange 226 between chamber 204 and low humidity environment 202, as noted above. The open position 210 can be a fully-open position and the closed position 208 can be a fully-closed position. In other embodiments, the open position 210 can be any position between the fully-open position and the fully-closed position. In FIG. 4, damper 206 is shown in the open position 210 in a position between the fully-open and fully-closed position. When damper 206 is in the open position 210, damper 206 defines an opening 207. Damper 206 is selectively actuated between one of the open positions 210 and the closed position 208 by motor 212. Motor 212 can be powered by any suitable means, such as e.g., battery power, one or more wired connections to a power supply, etc. Motor 212 is communicatively coupled with controller 190. Motor 212 can receive one or more signals from controller 190. Such signals can include instructions to activate motor 212 to actuate damper 206 to one of the open positions 210 or the closed position 208. Motor 212 can also send signals to controller 190. In this way, motor 212 can provide feedback of the position of damper 206.

A humidity sensor 214 is positioned within chamber 204. Humidity sensor 214 senses the humidity (i.e., absolute humidity), dew point, partial pressure of water vapor, and/or relative humidity of the air within chamber 204. Humidity sensor 214 is communicatively coupled with controller 190. In this way, humidity sensor 214 can send controller 190 one or more signals and controller 190 can receive the signals from humidity sensor 214. Additionally, controller 190 can send humidity sensor 214 one or more signals and humidity sensor 214 can receive the signals from controller 190. For example, humidity sensor 214 can send and controller 190 can receive one or more signals indicative of the humidity, dew point, partial pressure, and/or relative humidity of the air within chamber 204. Stated alternatively, controller 190 can receive one or more humidity values $H_{VALUE}$ from humidity sensor 214. The humidity value $RH_{VALUE}$ can be any parameter that can be used by controller 190 (or a chip or microcontroller of humidity sensor 214) to determine the relative humidity of chamber 204. For example, humidity value $RH_{VALUE}$ can be a value indicative of the absolute humidity, dew point, partial pressure of water vapor, relative humidity, or any other parameter or combination thereof that can be used to ultimately quantify the relative humidity of chamber 204. For this embodiment, controller 190 receives one or more relative humidity values $RH_{VALUE}$ from humidity sensor 214. Based at least in part on the relative humidity value $RH_{VALUE}$, controller 190 can activate motor 212 to actuate damper 206 to one of the open positions 210 or the closed position 208.

An air circulation device 216 is positioned within chamber 204 proximate damper 206. In some embodiments, however, air circulation device 216 can be positioned outside of chamber 204 but still proximate damper 206. Air circulation device 216 circulates airflow into or out of chamber 204. In this way, air circulation device 216 aids in air exchange between chamber 204 and low humidity environment 202. For instance, when the humidity within chamber 204 is above a humidity set point $H_{SET\ POINT}$, air circulation device 216 can push or blow humid air out of chamber 204 and/or can draw dryer, less humid air from low humidity environment 202 into chamber 204. Air circulation device 216 can be any suitable device for regulating airflow, including e.g., a fan or blower. For this embodiment, air circulation device 216 is a variable speed fan.

Air circulation device 216 is communicatively coupled with controller 190. In this manner, controller 190 can set air circulation device 216 to an "on" or "off" mode, and can control the fan speed, fan rotational direction (i.e., to direct the airflow into or out of the chamber 204), and to synchronize the air circulation device 216 with the opening or closing of damper 206. For example, when controller 190 activates motor 212 to actuate damper 206 to one of the open positions 210, controller 190 can likewise send one or more signals to activate air circulation device 216 to modulate the airflow or airflow exchange between chamber 204 and low humidity environment 202. The one or more signals can include instructions for fan speed and fan rotational direction, for example. Air circulation device 216 can be activated based at least in part on the humidity value $H_{VALUE}$ received from the humidity sensor 214.

In some embodiments, air circulation device 216 need not be communicatively coupled with controller 190. In such embodiments, air circulation device 216 can be a single speed fan that is always set to an "on" mode of operation, for example. In yet other embodiments, humidity control system 200 may not include an air circulation device 216 but rather may rely on passive diffusion or convection currents for airflow exchange between chamber 204 and low humidity environment 204.

Referring still to FIG. 4, for this exemplary embodiment, a humidifier 218 is positioned within chamber 204. Humidifier 218 may be any suitable type of humidifier capable of increasing the humidity of chamber 204, such as e.g., an ultrasonic humidifier, a warm mist humidifier, a cool mist humidifier, a vaporizer humidifier, etc. For this embodiment, humidifier 218 is an ultrasonic humidifier that provides moisture 220 to chamber 204. Humidifier 218 is communicatively coupled with controller 190. In this manner, when the humidity within chamber 204 is below a selected humidity set point $H_{SET\ POINT}$, controller 190 can activate humidifier 218 to provide moisture 220 to chamber 204.

In some embodiments, humidity control system 200 need not include humidifier 218. In such embodiments, moisture 220 can be added to chamber 204 by evaporation or moisture loss from various food items 224 (or other items) stowed within chamber 204.

An image sensor 222 is positioned within chamber 204 for this embodiment. Image sensor 222 can be any suitable sensing device capable of sensing the contents or items stowed or placed within chamber 204. For this embodiment, image sensor 222 is a digital camera configured to capture images of the items stowed within chamber 204. The image sensor 222 is communicatively coupled with controller 190. In this way, controller 190 can receive various images taken by image sensor 222 and can then process the signals to classify the contents within chamber 204. Once the contents within chamber 204 are classified, the humidity set point $H_{SET}$ POINT can be set by controller 190 based at least in part on the classified contents within chamber 204.

By way of example, suppose food items 224 are representative of spinach. Image sensor 222 can capture the image of the spinach and then can send one or more signals to controller 190. Controller 190 then processes the signals. Controller 190 can include a library stored in one or more of its memory devices that includes a database of images. Controller 190 can include one or more image classification software applications that can determine that, based on the images captured by image sensor 222, the contents within chamber 204 is in fact a bag of spinach. Based on the classification, controller 190 can set the humidity set point $H_{SET\ POINT}$ to the appropriate setting that best suits spinach. If more than one type of food item 224 is present within chamber 204, controller 190 can determine a "best humidity set point" for the particular contents within chamber 204.

In some embodiments, humidity control system 200 need not include image sensor 222. For some embodiments, for example, a gas sensor is positioned within chamber 204. Gas sensor can be any suitable sensing device capable of sensing one or more gasses emitted from food items 224 stowed or placed within chamber 204. For example, gas sensor can be a wireless chip that reacts to small traces of ethylene and/or other chemical traces indicative of a particular food type released from food items 224. The gas sensor is communicatively coupled with controller 190. In this way, controller 190 can receive various signals from gas sensor and can then process the signals to classify the contents within chamber 204. Once the contents within chamber 204 are classified, the humidity set point $H_{SET\ POINT}$ can be set by controller 190 based at least in part on the classified contents within chamber 204.

In yet other exemplary embodiments in which humidity control system 200 need not include image sensor 222, the humidity set point $H_{SET\ POINT}$ for chamber 204 can be set by a user, for example. A user can place one or more food items 224 within chamber 204 and then can input or classify the contents by user manipulation of one or more user interfaces of refrigerator appliance 100. As another example, chamber 204 can be a designated storage compartment and the humidity set point $H_{SET\ POINT}$ can be set for a constant humidity set point. Such a constant humidity set point $H_{SET\ POINT}$ can be useful when storing items such as e.g., works of art or artifacts. In such embodiments, the humidity set point $H_{SET\ POINT}$ can be set at an optimal level for the particular items within chamber 204.

Chamber 204 can approximate any humidity state that exists above the relative humidity of low humidity environment 202. For example, if low humidity environment 202 is at 20% relative humidity (RH), humidity control system 200 can modulate the relative humidity within chamber 204 to between 20% and 100% RH. The humidity within chamber 204 can be held static (i.e., hold 50% RH) or dynamic (i.e., cycle humidity between 50%-90% RH). Controller 190 in combination with the various elements of humidity control system 200 that are communicatively coupled with controller 190 can be arranged in a feedback loop that allows the relative humidity of chamber 204 to be controlled in accordance with the desired static or dynamic humidity set point $H_{SET\ POINT}$.

During operation of humidity control system 200, when the relative humidity within chamber 204 is lower than the desired or set point humidity $H_{SET\ POINT}$, damper 206 is actuated to the closed position 208 and humidifier 218 is activated to generate humidity within chamber 204 by adding moisture 220 thereto. The humidity value $H_{VALUE}$ can then be constantly compared or compared at certain time intervals to the humidity set point $H_{SET\ POINT}$. When the humidity value $H_{VALUE}$ is equal to or approximately equal (i.e., within five percent (5%)) to the humidity set point $H_{SET\ POINT}$, controller 190 sends one or more signals to humidifier 218 to cease from adding moisture 220 to chamber 204.

When the relative humidity within chamber 204 is higher than the desired or humidity set point $H_{SET\ POINT}$, controller 190 activates motor 212 to actuate damper 206 to one of the open positions 210 and controller 190 activates air circulation device 216 to assist in exhausting humid air from chamber 204 into low humidity environment 202. The humidity value $H_{VALUE}$ can then be constantly compared or compared at certain time intervals to the humidity set point $H_{SET\ POINT}$. When the humidity value $H_{VALUE}$ is equal to or approximately equal (i.e., within five percent (5%)) to the humidity set point $H_{SET\ POINT}$, controller 190 sends one or more signals to motor 212 to actuate damper 206 to the closed position 208 and controller 190 sends one or more signals to air circulation device 216 to cease operation.

Figure 5:
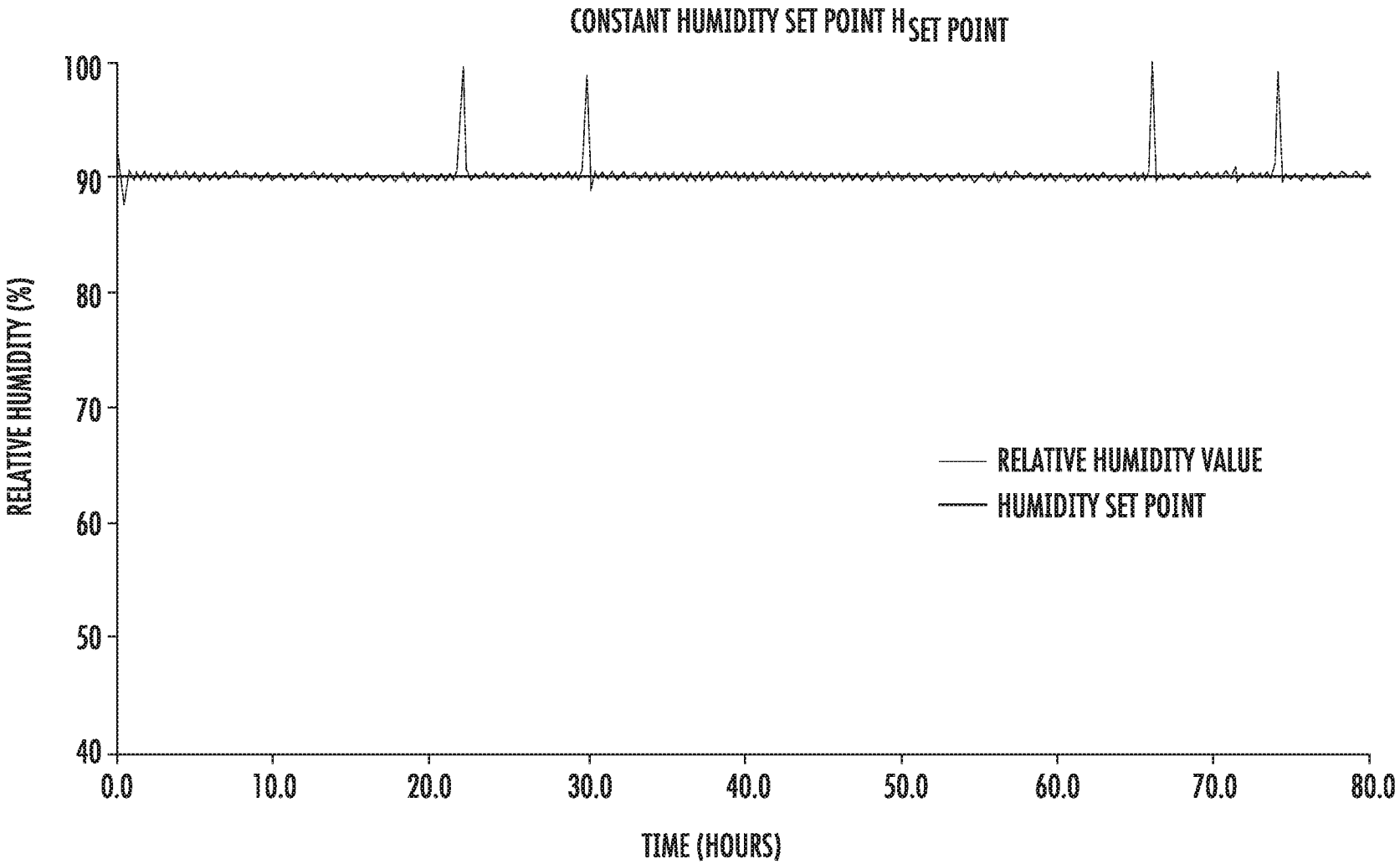
FIG. 5 provides a graph illustrating the relative humidity of an exemplary chamber controlled as a constant function according to exemplary embodiments of the present disclosure.

Humidity control system 200 can control the relative humidity of chamber 204 at a constant humidity level. FIG. 5 provides a graph illustrating chamber 204 of refrigerator appliance 100 controlled as a constant function (i.e., a constant humidity level) according to exemplary embodiments of the present disclosure. Specifically, FIG. 5 provides a relative humidity (percentage) versus time graph of chamber 204 held at a constant humidity set point $H_{SET\ POINT}$ at ninety percent (90%) RH.

As shown, the humidity value $H_{VALUE}$, or in this case the relative humidity value $RH_{VALUE}$, substantially tracked with or stabilized at the ninety percent (90%) RH humidity set point $H_{SET\ POINT}$. In some instances during the eighty (80) hour period, however, the relative humidity value $RH_{VALUE}$ within chamber 204 spiked. The various spikes in relative humidity to approximately one hundred percent (100%) RH were due to various defrost cycles of refrigerator appliance 100. During such defrost cycles, various parts of refrigerator appliance 100 were warmed, and as a result, moisture evaporated into fresh food chamber 122. Consequently, the relative humidity of low humidity environment 202 spiked and thus there was no place for moisture 220 within chamber 204 to escape during an airflow exchange 226 to remove humidity from chamber 204. However, after the various defrost cycles were completed, the relative humidity value $RH_{VALUE}$ of chamber 204 substantially stabilized at the desired humidity set point $H_{SET\ POINT}$ of ninety percent (90%) RH. A user may desire to set the humidity level of chamber 204 as a constant function at about 90% RH based at least in part on the items within chamber 204, such as e.g., when vegetables or fruits are stored in chamber 204. It will be appreciated that the constant humidity set point $H_{SET\ POINT}$ can be set to any suitable relative humidity level, such as e.g., eighty percent (80%) RH, seventy percent (70%) RH, sixty percent (60%) RH, etc.

Humidity control system 200 can also control the humidity level of chamber 204 dynamically. As one example, humidity control system 200 can control the humidity level of chamber 204 as a sinusoidal function, as it may be desirable to simulate nighttime and daytime cycles for food items 224, and in particular, fruit and vegetable food items. By simulating daytime and nighttime conditions, chamber 204 may more closely approximate the humidity conditions that the food items 224 were in prior to being harvested. Generally, the air is cooler during nighttime conditions and thus the air cannot hold as much moisture. On the other hand, during daytime conditions, the air is generally warmer and thus the air can hold more moisture. By varying the humidity set point $H_{SET\ POINT}$ as a sinusoidal function, the food items 224 within chamber 204 may undergo the same or similar cycles the food items 224 underwent prior to being harvested. In this manner, the food items 224 may better be preserved. There may other reasons, benefits, advantages, etc. of setting the humidity set point $H_{SET\ POINT}$ as a sinusoidal function in addition to the reasons noted above, such as to better control the amount of moisture within fresh food chamber 122 of refrigerator appliance 100.

Figure 6:
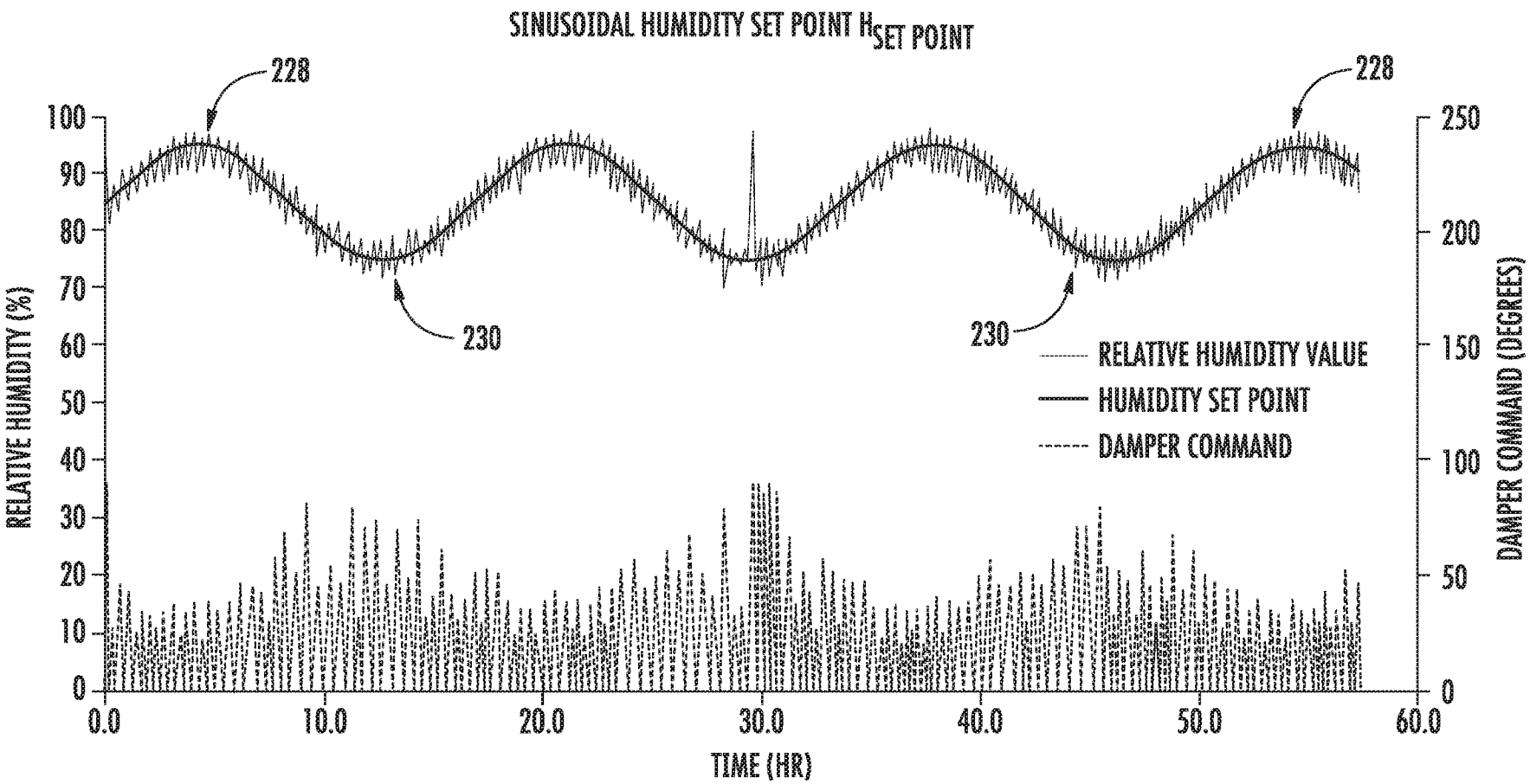
FIG. 6 provides a graph illustrating the relative humidity of an exemplary chamber controlled as a sinusoidal function according to exemplary embodiments of the present disclosure.

FIG. 6 provides a graph illustrating chamber 204 of refrigerator appliance 100 controlled as a sinusoidal function according to exemplary embodiments of the present disclosure. More specifically, FIG. 6 provides a relative humidity (percentage) versus time graph of chamber 204. The humidity set point $H_{SET\ POINT}$ is set at eighty-five (85%) RH and varies in phase over time by about twenty percent (20%) relative humidity. That is, the sinusoidal function varies upward to about ninety-five percent (95%) RH from eighty-five percent (85%) RH and downward to about seventy-five percent (75%) RH from eighty-five percent (85%) RH. Thus, generally, the maximum amplitude of the sinusoidal function is about ten percent (10%) RH. As shown, humidity control system 200 regulated the humidity of chamber 204 in accordance with the sinusoidal function. The relative humidity value $RH_{VALUE}$ or actual relative humidity of chamber 204 is shown tracking the sinusoidal function. To accomplish such humidity control, damper 206 is opened and closed between one of the open positions 210 and the closed position 208. The damper command (degrees) or position is shown as a function of time in FIG. 6 as a dashed line. During one of the peaks 228 of the sinusoidal function, damper 206 is positioned or actuated more closed to trap the existing moisture within chamber 204 to increase the relative humidity of the air within chamber 204. During one of the valleys 230 of the sinusoidal function, damper 206 is positioned or actuated more open to allow for an increased airflow exchange 226 between chamber 204 and low humidity environment 202. In this way, moisture 220 can escape from chamber 204 to low humidity environment 202. Additionally, air circulation device 216 can be activated to increase the rate of airflow exchange 226.

Figure 7:
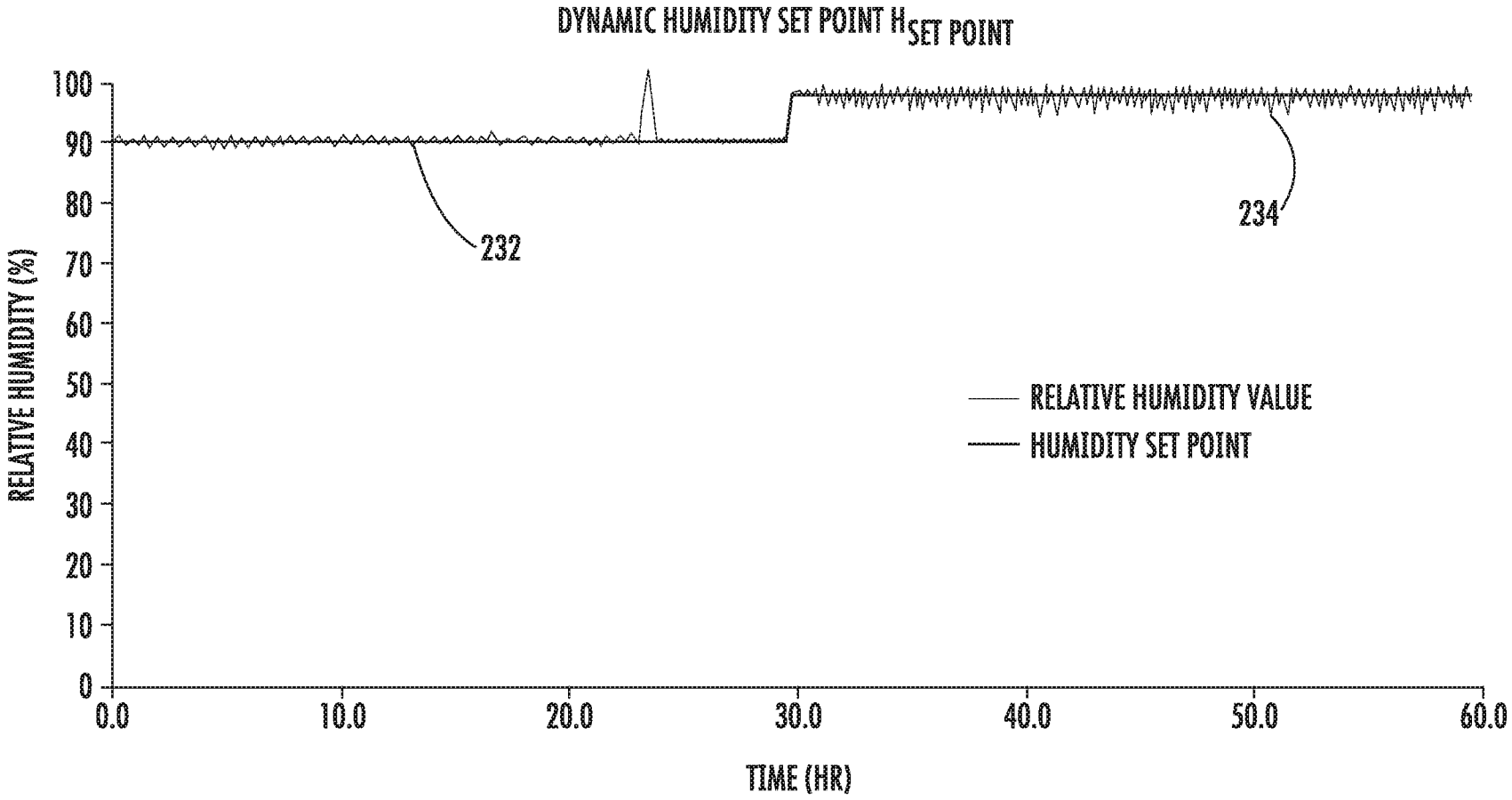
FIG. 7 provides a graph illustrating the relative humidity of an exemplary chamber dynamically controlled based on the items within chamber according to exemplary embodiments of the present disclosure.

FIG. 7 provides a graph illustrating chamber 204 of refrigerator appliance 100 dynamically controlled based on the items within chamber 204 according to exemplary embodiments of the present disclosure. More specifically, FIG. 7 provides a relative humidity (percentage) versus time graph of chamber 204. As shown, controller 190 has determined that a first item 232, in this example blueberries, is being stored in chamber 204. Based at least in part on the fact that first item 232 (i.e., blueberries) is present in chamber 204, controller 190 sets the humidity set point $H_{SET}$ POINT to ninety percent (90%) RH and humidity control system 200 controls the relative humidity within chamber 204 as near as possible to the humidity set point $H_{SET\ POINT}$. The first item 232 is shown being stored in chamber 204 from the zero (0) hour mark until about the thirty (30) hour mark.

At about the thirty (30) hour mark, controller 190 determines that first item 232 is no longer present within chamber 204. Rather, a second item 234, in this example a bag of spinach, is being stored in chamber 204. Based at least in part on the fact that second item 234 (i.e., a bag of spinach) is now present in chamber 204, controller 190 sets the humidity set point $H_{SET\ POINT}$ to ninety-five percent (95%) RH, and humidity control system 200 controls the relative humidity within chamber 204 as near as possible to the humidity set point $H_{SET\ POINT}$. In this manner, humidity control system 200 is a dynamic humidity control system that can adjust the humidity set point $H_{SET\ POINT}$ and consequently the relative humidity value $RH_{VALUE}$ of the air within chamber 204 based at least in part on the one or more items within chamber 204.

As noted previously, any suitable method can be used to determine the type or classification of the items within chamber 204. For example, a user can manipulate one or more user interfaces of refrigerator appliance 100 to denote the type of items within chamber 204. For instance, a user could use voice control to instruct controller 190 that carrots and broccoli have been placed within chamber 204. Based on these inputs, controller 190 can access a database stored in memory or in a cloud network to determine the appropriate humidity set point $H_{SET\ POINT}$ for the contents within chamber 204. Accordingly, humidity control system 200 can regulate chamber 204 to the appropriate humidity level. As another example, image sensor 222 can capture one or more images of the contents or items within chamber 204. Controller 190 can receive these captured images as signals from image sensor 222 and can determine or classify the items within chamber 204 by using a database stored in memory or in a cloud network to compare the images to labeled data via one or more statistical or machine learning techniques, for example. Upon determination or classification of the items within chamber 204, controller 190 sets the humidity of chamber 204 to the appropriate humidity set point $H_{SET\ POINT}$ and humidity control system 200 regulates chamber 204 to the appropriate humidity level.

Figure 8:
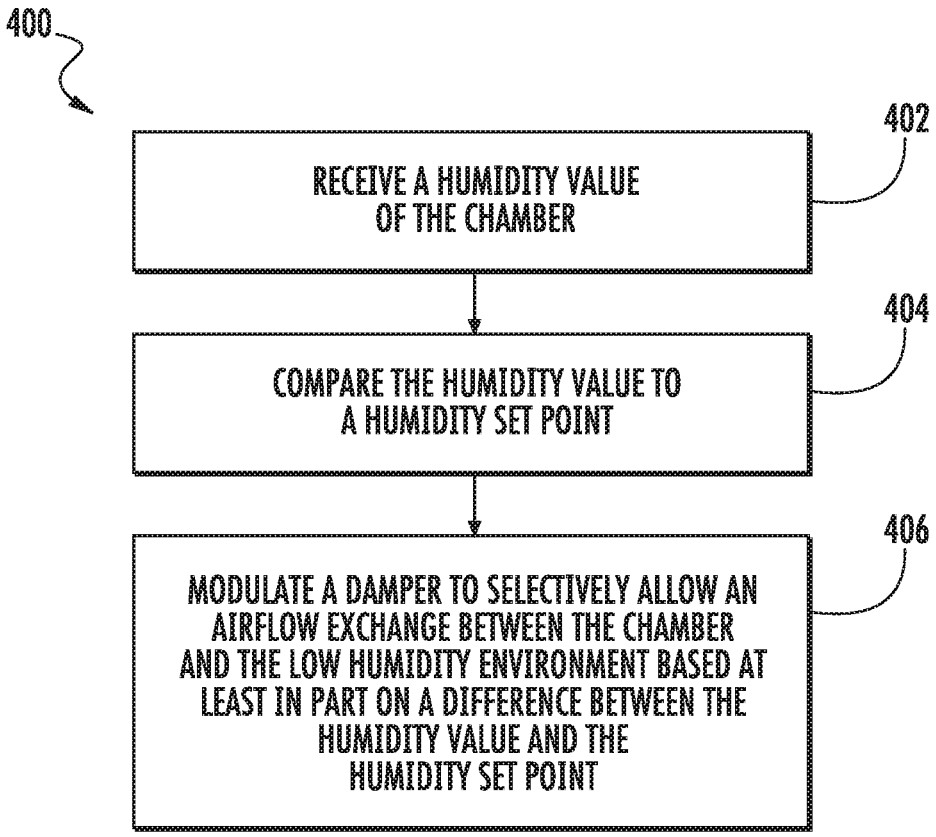
FIG. 8 provides a flow diagram of an exemplary method for controlling the relative humidity of a chamber according to exemplary embodiments of the present disclosure.

FIG. 8 provides a flow diagram of a method (400) for controlling the relative humidity of a chamber 204 according to exemplary embodiments of the present disclosure. Method (400) can be used to operate any suitable humidity control system 200. As an example, method (400) may be used to operate humidity control system 200 (FIG. 4) of refrigerator appliance 100 (FIG. 1). Controller 190 and the various components of humidity control system 200 can implement method (400). Utilizing method (400), a specific humidity state of chamber 204 can be achieved.

At (402), exemplary method (400) includes receiving a humidity value $H_{VALUE}$ of chamber 204. For example, the humidity value $H_{VALUE}$ can be a relative humidity value $RH_{VALUE}$. The relative humidity value $RH_{VALUE}$ can be eighty-five percent (85%) RH. In some embodiments, controller 190 can receive the humidity value $H_{VALUE}$ from humidity sensor 214.

At (404), exemplary method (400) includes comparing the humidity value $H_{VALUE}$ to humidity set point $H_{SET\ POINT}$. After controller 190 receives the humidity value $H_{VALUE}$ from humidity sensor 214, controller 190 compares the humidity value $H_{VALUE}$ to the humidity set point $H_{SET\ POINT}$, which might be a constant function, a sinusoidal function, or a function based at least in part on the items or contents within chamber 204, for example.

At (406), exemplary method (400) includes modulating damper 206 to selectively allow an airflow exchange 226 between chamber 204 and low humidity environment 202 based at least in part on a difference between the humidity value $H_{VALUE}$ and the humidity set point $H_{SET\ POINT}$. Once controller 190 compares the humidity value $H_{VALUE}$ to the humidity set point $H_{SET\ POINT}$, a difference between the two can be determined. Based on the difference, controller 190 can modulate damper 206 to allow airflow exchange 226 between chamber 204 and low humidity environment 202.

In some exemplary implementations, method (400) further includes modulating air circulation device 216 to increase a rate of airflow exchange 226 between chamber 204 and low humidity environment 202 based at least in part on the difference between the humidity value $H_{VALUE}$ and the humidity set point $H_{SET\ POINT}$.

In some exemplary implementations, humidity control system 200 includes humidifier 218. Humidifier 218 is positioned within chamber 204. The method (400) further includes increasing the relative humidity of chamber 204 via humidifier 218 based at least in part on the difference between the humidity value $H_{VALUE}$ and the humidity set point $H_{SET\ POINT}$.

In some exemplary implementations, humidity control system 200 includes humidity sensor 214. Humidity sensor 214 is positioned within chamber 204. The method (400) further includes sensing the humidity value $H_{VALUE}$ of chamber 204 with the humidity sensor 214.

In some exemplary implementations, humidity control system 200 includes humidity sensor 214. Humidity sensor 214 is positioned within chamber 204. The method (400) further includes sensing the relative humidity value $RH_{VALUE}$ of chamber 204 with the humidity sensor 214.

In some exemplary implementations, the humidity set point $H_{SET\ POINT}$ is a sinusoidal function. Moreover, in some implementations, the sinusoidal function varies in phase over time by about twenty percent (20%) relative humidity. In yet other exemplary implementations, the humidity set point $H_{SET\ POINT}$ is a constant function.

In yet other exemplary implementations, method (400) further includes determining the type of one or more items within chamber 204. The method (400) also includes adjusting the humidity set point $H_{SET\ POINT}$ based at least in part on the one or more items within chamber 204. In some embodiments, an image sensor 222 in combination with controller 190 can be used to sense and determine the food items within chamber 204. In some other embodiments, a gas sensor in combination with controller 190 can be used to sense and determine the food items within chamber 204.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A humidity control system for regulating the relative humidity of a chamber enclosed within a low humidity environment, the humidity control system comprising:

a damper adjustable between one or more open positions and a closed position for selectively allowing an airflow exchange between the chamber and the low humidity environment;

a motor for selectively actuating the damper between the one or more open positions and the closed position;

a humidity sensor positioned within the chamber; and a controller communicatively coupled with the humidity sensor and the motor, the controller configured to:

receive a humidity value from the humidity sensor; and modulate a damper to selectively allow an airflow exchange between the chamber and the low humidity environment based at least in part on a difference between the humidity value and a humidity set point, wherein the humidity set point is a sinusoidal function.

2. The humidity control system of claim 1, wherein after receiving the humidity value from the humidity sensor, the controller is further configured to compare the humidity value to the humidity set point.

3. The humidity control system of claim 1, wherein the humidity set point is selected by a user.

4. The humidity control system of claim 1, wherein the humidity set point is selected by the controller based at least in part on one or more items placed within the chamber.

5. The humidity control system of claim 1, wherein the low humidity environment is a refrigerator appliance and the chamber is a refrigerator compartment of the refrigerator appliance.

6. The humidity control system of claim 1, further comprising:

an air circulation device for circulating the airflow into or out of the chamber, the air circulation device communicatively coupled with the controller; and wherein the controller is further configured to:

activate the air circulation device to modulate the airflow based at least in part on the humidity value received from the humidity sensor.

7. The humidity control system of claim 1, further comprising:

a humidifier positioned within the chamber, the humidifier communicatively coupled with the controller; and wherein the controller is further configured to:

activate the humidifier to provide moisture to the chamber.

8. The humidity control system of claim 1, further comprising:

a humidifier positioned within the chamber and communicatively coupled with the controller; and wherein the controller is further configured to:

compare the humidity value to the humidity set point; and increase the relative humidity of the chamber via the humidifier based at least in part on a difference between the humidity value and the humidity set point.

9. The humidity control system of claim 1, wherein the chamber has a relative humidity between about seventy-five (75%) and about one hundred percent (100%).

10. The humidity control system of claim 1, wherein the low humidity environment has a relative humidity between about twenty percent (20%) and about fifty percent (50%).

11. The humidity control system of claim 1, wherein the humidity value is indicative of a relative humidity value of the chamber.

12. A method for regulating the relative humidity of a chamber enclosed within a low humidity environment, the method comprising:

receiving a humidity value of the chamber;

comparing the humidity value to a humidity set point; and modulating a damper to selectively allow an airflow exchange between the chamber and the low humidity environment based at least in part on a difference between the humidity value and the humidity set point, wherein the humidity set point is a sinusoidal function.

13. The method of claim 12, wherein the method further comprises:

modulating an air circulation device to increase a rate of the airflow exchange between the chamber and the low humidity environment based at least in part on the difference between the humidity value and the humidity set point.

14. The method of claim 12, wherein a humidifier is positioned within the chamber, and wherein the method further comprises:

increasing the relative humidity of the chamber via the humidifier based at least in part on the difference between the humidity value and the humidity set point.

15. The method of claim 12, wherein a humidity sensor is positioned within the chamber, and wherein the method further comprises:

sensing the humidity value of the chamber with the humidity sensor.

16. The method of claim 12, wherein the sinusoidal function varies in phase over time by about twenty percent (20%) relative humidity.

17. The method of claim 12, wherein the method further comprises:

determining the type of one or more items within the chamber; and adjusting the humidity set point based at least in part on the one or more items within the chamber.

* * * * *